US008638262B2

(12) United States Patent
Arkko et al.

(10) Patent No.: US 8,638,262 B2
(45) Date of Patent: Jan. 28, 2014

(54) APPARATUS FOR WIRELESS COMMUNICATION COMPRISING A LOOP LIKE ANTENNA

(75) Inventors: Aimo Arkko, Ruutana (FI); Jens Troelsen, Copenhagen (DK); Rune Skipper Soe, Copenhagen (DK)

(73) Assignee: Nokia Corporation, Espoo (FI)

( * ) Notice: Subject to any disclaimer, the term of this patent is extended or adjusted under 35 U.S.C. 154(b) by 139 days.

(21) Appl. No.: 13/381,854

(22) PCT Filed: Jun. 30, 2009

(86) PCT No.: PCT/EP2009/058209

§ 371 (c)(1),
(2), (4) Date: Mar. 16, 2012

(87) PCT Pub. No.: WO2011/000416

PCT Pub. Date: Jan. 6, 2011

(65) Prior Publication Data

US 2012/0194404 A1 Aug. 2, 2012

(51) Int. Cl.
*H01Q 1/24* (2006.01)
*H01Q 7/00* (2006.01)

(52) U.S. Cl.
USPC ..... 343/702; 343/866; 343/846

(58) Field of Classification Search
USPC ..... 343/702, 866, 846
See application file for complete search history.

(56) References Cited

U.S. PATENT DOCUMENTS

| | | | | |
|---|---|---|---|---|
| 7,068,230 | B2 | 6/2006 | Qi et al. | |
| 7,307,591 | B2 | 12/2007 | Zheng | |
| 7,605,764 | B2 * | 10/2009 | Ishimiya | 343/702 |
| 8,164,537 | B2 * | 4/2012 | Kinezos et al. | 343/803 |
| 8,193,993 | B2 * | 6/2012 | Maddaleno | 343/702 |
| 8,212,730 | B2 * | 7/2012 | Qi et al. | 343/702 |
| 2004/0090372 | A1 | 5/2004 | Nallo et al. | |
| 2007/0008222 | A1 | 1/2007 | Wang et al. | |
| 2007/0182658 | A1 | 8/2007 | Ozden | |
| 2008/0042916 | A1 | 2/2008 | Ma | |
| 2008/0136727 | A1 | 6/2008 | Bit-Babik et al. | |

FOREIGN PATENT DOCUMENTS

| | | | |
|---|---|---|---|
| EP | 1684379 | A1 | 7/2006 |
| GB | 2415832 | A | 1/2006 |

OTHER PUBLICATIONS

Hayashida et al., "Wideband Folded Loop Antenna for Handsets", IEEE Antennas and Propagation Society International Symposium, vol. 3, Jun. 16-21, 2002, 4 pages.

International Search Report and Written Opinion received for corresponding Patent Cooperation Treaty Application No. PCT/EP2009/058209, dated Dec. 10, 2009, 13 pages.

* cited by examiner

*Primary Examiner* — Hoang V Nguyen
(74) *Attorney, Agent, or Firm* — Nokia Corporation

(57) ABSTRACT

Apparatus (20) comprising: an antenna (12) connectable to a first terminal (38) and to a second terminal (40) and comprising a first conductive part (34) and a second conductive part (36), the first conductive part being configured electrically in parallel with the second conductive part, the first conductive part (34) being configured to have a first electrical length and the second conductive part (36) being configured to have a second electrical length together providing a common resonant mode having a first operational frequency band, the second conductive part (36) substantially providing a common resonant mode having a second operational frequency band and the first conductive part (34) substantially providing a differential resonant mode having a third operational frequency band.

20 Claims, 8 Drawing Sheets

APPARATUS FOR WIRELESS COMMUNICATION COMPRISING A LOOP LIKE ANTENNA

RELATED APPLICATION

This application was originally filed as PCT Application No. PCT/EP 2009/058209 on Jun. 30, 2009, which is incorporated herein by reference in its entirety.

FIELD OF THE INVENTION

Embodiments of the present invention relate to apparatus for wireless communication. In particular, they relate to apparatus for wireless communication in a portable device.

BACKGROUND TO THE INVENTION

Apparatus, such as mobile cellular telephones, usually include one or more antennas for wireless communication and an audio output device which is configured to be placed in close proximity to a user's ear to provide sound waves. Some users of such an apparatus may have hearing difficulties and may wear a hearing aid for amplifying sound waves which are incident on the user's ear. However, the output of a hearing aid may be affected by electromagnetic interference with the one or more antennas of the apparatus. This may result in the user not hearing some, or all, of the output from the audio output device.

It would therefore be desirable to provide an alternative apparatus.

BRIEF DESCRIPTION OF VARIOUS EMBODIMENTS OF THE INVENTION

According to various, but not necessarily all, embodiments of the invention there is provided apparatus comprising: an antenna connectable to a first terminal and to a second terminal and comprising a first conductive part and a second conductive part, the first conductive part being configured electrically in parallel with the second conductive part, the first conductive part being configured to have a first electrical length that provides a differential resonant mode having a first operational frequency band.

The first conductive part may be configured to provide the antenna, including the first conductive part, with an electrical length substantially equal to a wavelength of an electromagnetic wave in the first operational frequency band.

The second conductive part may be configured to have a second electrical length that provides a differential resonant mode having a second operational frequency band. The second conductive part may be configured to provide the antenna, including the second conductive part, with an electrical length substantially equal to a wavelength of an electromagnetic wave in the second operational frequency band.

The first operational frequency band and the second operational frequency band may at least partially overlap.

The first operational frequency band and the second operational frequency band may be non-overlapping.

The first conductive part may be physically shorter than the second conductive part.

The apparatus may further comprise a ground member having a first end and a second end. The ground member may comprise a first terminal at the first end. The first terminal may be connectable to the antenna. The ground member may include a second terminal at the first end. The second terminal may be connectable to the antenna.

The first conductive part may comprise a portion positioned in proximity to the first terminal and to the second terminal. The portion may be configured to electromagnetically couple to the first terminal and to the second terminal.

The second conductive part may comprise a portion positioned in proximity to the first terminal and to the second terminal. The portion may be configured to electromagnetically couple to the first terminal and to the second terminal.

The antenna may be positioned to at least partially overlay the ground member.

The antenna may be positioned adjacent the ground member in a non-overlaying arrangement.

The apparatus may further comprise an audio output device positioned at the second end of the ground member. The audio output device may be configured to provide sound waves to a user, the differential resonant mode of the antenna providing a Hearing Aid Compliant (HAC) mode.

According to various, but not necessarily all, embodiments of the invention there is provided a module comprising an apparatus as described in any of the preceding paragraphs.

According to various, but not necessarily all, embodiments of the invention there is provided a portable device comprising an apparatus as described in any of the preceding paragraphs.

According to various, but not necessarily all, embodiments of the invention there is provided a method comprising: providing an antenna connectable to a first terminal and to a second terminal and comprising a first conductive part and a second conductive part, the first conductive part being configured electrically in parallel with the second conductive part; and configuring the first conductive part to have a first electrical length that provides a differential resonant mode having a first operational frequency band.

The first conductive part may provide the antenna, including the first conductive part, with an electrical length substantially equal to a wavelength of an electromagnetic wave in the first operational frequency band.

The method may further comprise configuring the second conductive part to have a second electrical length that provides a differential resonant mode having a second operational frequency band.

Configuring the second conductive part may provide the antenna, including the second conductive part, with an electrical length substantially equal to a wavelength of an electromagnetic wave in the second operational frequency band.

The first operational frequency band and the second operational frequency band may at least partially overlap.

The first operational frequency band and the second operational frequency band may be non-overlapping.

The first conductive part may be physically shorter than the second conductive part.

The method may further comprise providing a ground member having a first end and a second end and comprising a first terminal at the first end and connectable to the antenna, and a second terminal at the first end and connectable to the antenna.

The first conductive part may comprise a portion positioned in proximity to the first terminal and to the second terminal. The portion may be configured to electromagnetically couple to the first terminal and to the second terminal.

The second conductive part may comprise a portion positioned in proximity to the first terminal and to the second terminal. The portion may be configured to electromagnetically couple to the first terminal and to the second terminal.

The method may further comprise positioning the antenna to at least partially overlay the ground member.

The method may further comprise positioning the antenna adjacent the ground member in a non-overlaying arrangement.

The method may further comprise positioning an audio output device at the second end of the ground member and configured to provide sound waves to a user, the differential resonant mode of the antenna providing a Hearing Aid Compliant (HAC) mode.

BRIEF DESCRIPTION OF THE DRAWINGS

For a better understanding of various examples of embodiments of the present invention reference will now be made by way of example only to the accompanying drawings in which.

DETAILED DESCRIPTION OF VARIOUS EMBODIMENTS OF THE INVENTION

Figure 2:
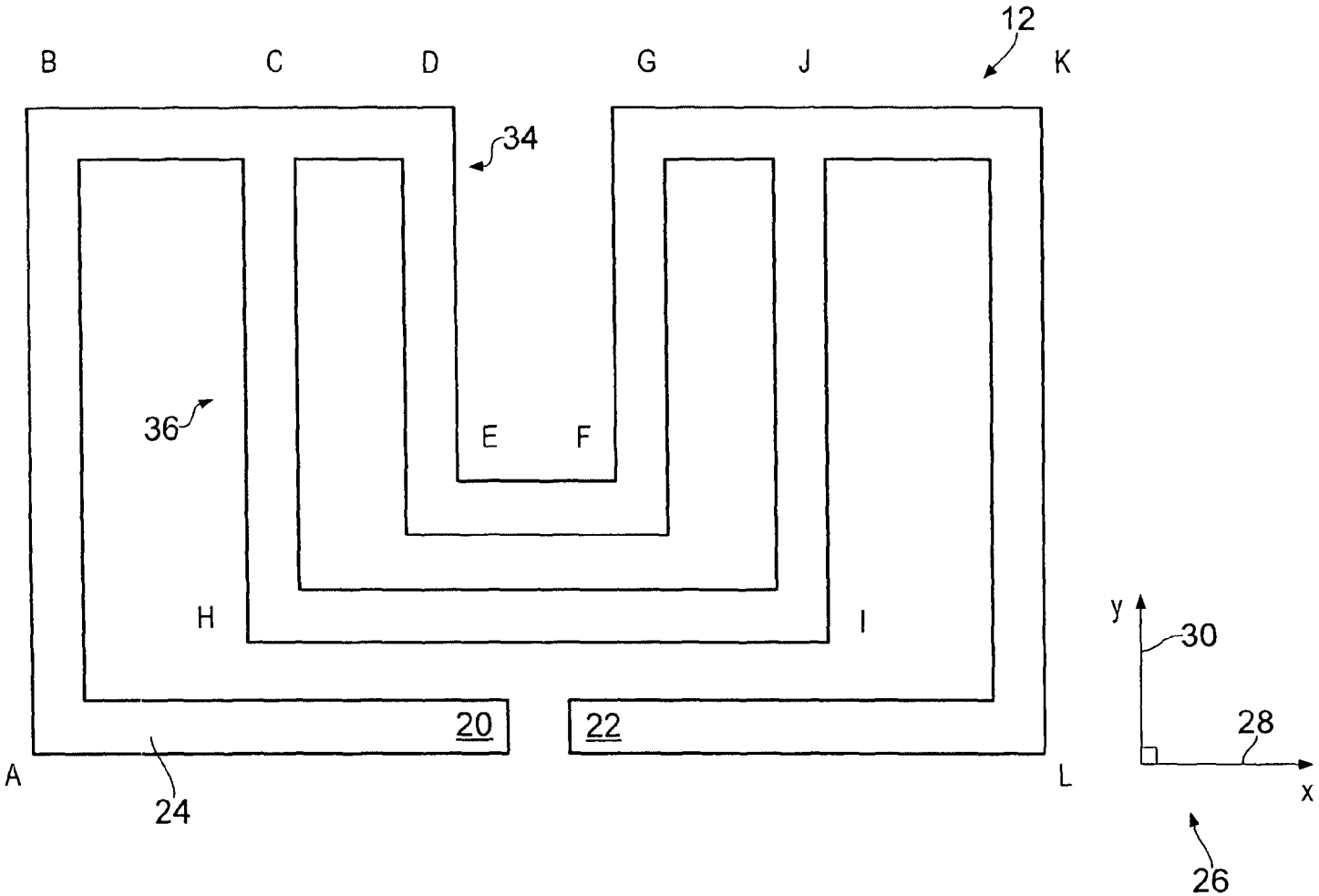
FIG. 2 illustrates a plan view of an antenna according to various embodiments of the invention.
Figure 3:
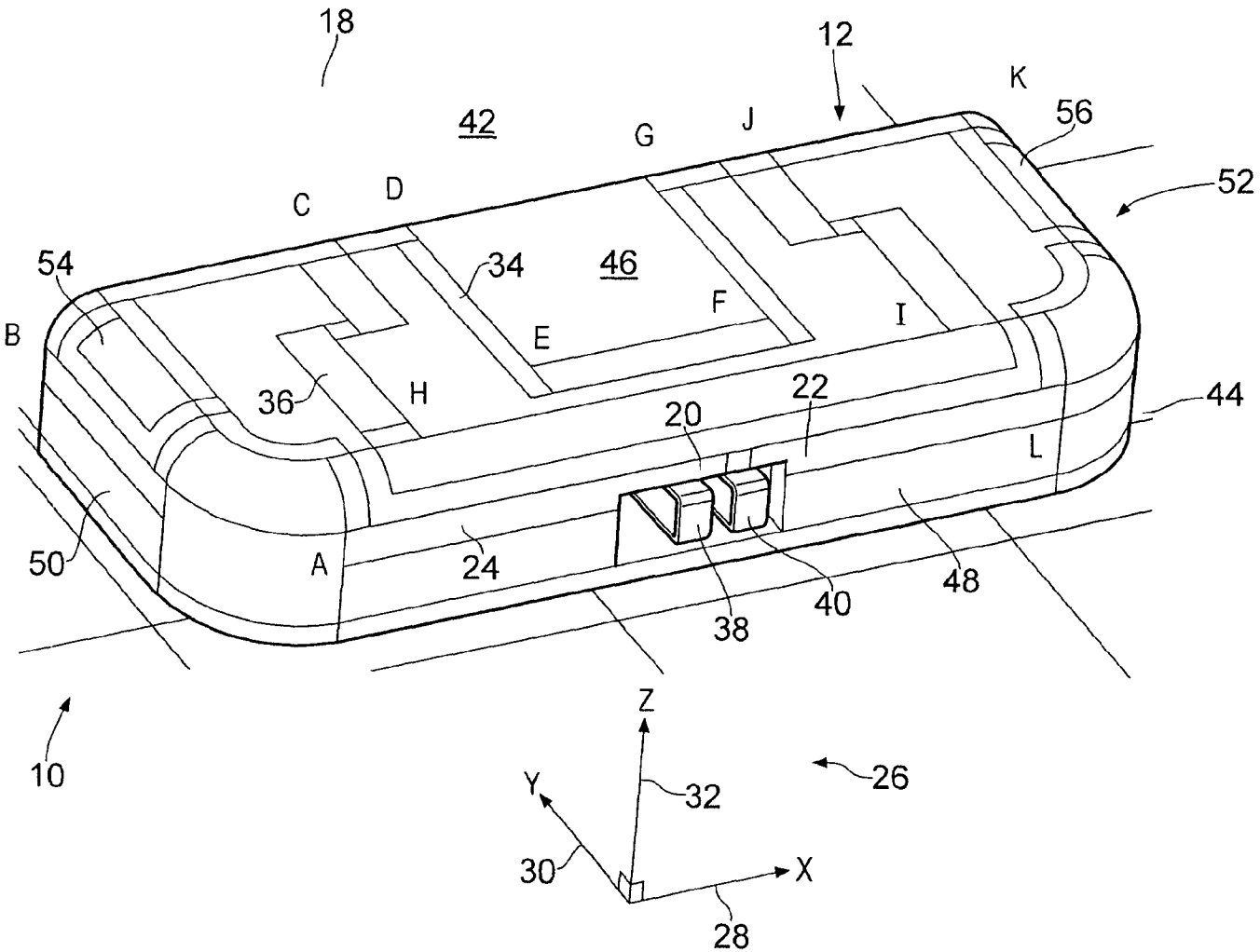
FIG. 3 illustrates a perspective view of an apparatus according to various embodiments of the invention.

FIGS. 2 and 3 illustrate apparatus 10 comprising: an antenna 12 connectable to a first terminal 38 and to a second terminal 40 and comprising a first conductive part 34 and a second conductive part 36, the first conductive part 34 being configured electrically in parallel with the second conductive part 36, the first conductive part 34 being configured to have a first electrical length and the second conductive part 36 being configured to have a second electrical length together providing a common resonant mode having a first operational frequency band, the second conductive part 36 substantially providing a common resonant mode having a second operational frequency band and the first conductive part 34 substantially providing a differential resonant mode having a third operational frequency band.

In the following description, the wording 'connect' and 'couple' and their derivatives mean operationally connected/coupled. It should be appreciated that any number or combination of intervening components can exist (including no intervening components). Additionally, it should be appreciated that the connection/coupling may be a physical galvanic connection and/or an electromagnetic connection.

Figure 1:
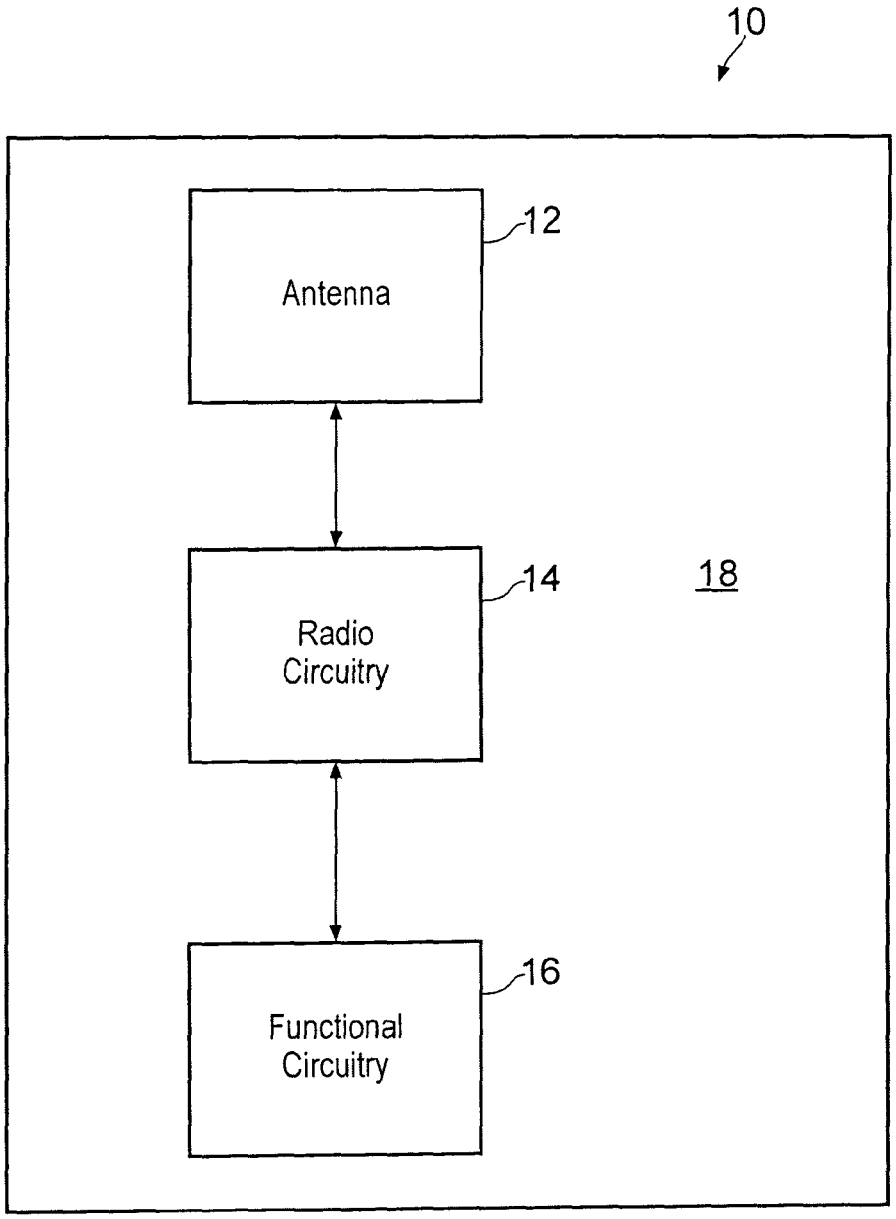
FIG. 1 illustrates a schematic diagram of an apparatus according to various embodiments of the present invention.

FIG. 1 illustrates an apparatus 10 such as a portable device (for example, a mobile cellular telephone, a personal digital assistant or any hand held computer) or a module for such devices. As used here, 'module' refers to a unit or apparatus that excludes certain parts/components that would be added by an end manufacturer or a user.

The apparatus 10 comprises an antenna 12, radio circuitry 14 and functional circuitry 16. The antenna 12 is configured to transmit and receive electromagnetic signals and will be described in more detail in the following paragraphs. The radio circuitry 14 is connected between the antenna 12 and the functional circuitry 16 and may include a receiver and/or a transmitter. The functional circuitry 16 is operable to provide signals to, and/or receive signals from the radio circuitry 14.

The antenna 12 and the radio circuitry 14 may be configured to operate in a plurality of different operational frequency bands and via a plurality of different protocols. For example, the different operational frequency bands and protocols may include (but are not limited to) Long Term Evolution (LTE) 700 (US) (698.0-716.0 MHz, 728.0-746.0 MHz), LTE 1500 (Japan) (1427.9-1452.9 MHz, 1475.9-1500.9 MHz), LTE 2600 (Europe) (2500-2570 MHz, 2620-2690 MHz), amplitude modulation (AM) radio (0.535-1.705 MHz); frequency modulation (FM) radio (76-108 MHz); Bluetooth (2400-2483.5 MHz); wireless local area network (WLAN) (2400-2483.5 MHz); helical local area network (HLAN) (5150-5850 MHz); global positioning system (GPS) (1570.42-1580.42 MHz); US-Global system for mobile communications (US-GSM) 850 (824-894 MHz); European global system for mobile communications (EGSM) 900 (880-960 MHz); European wideband code division multiple access (EU-WCDMA) 900 (880-960 MHz); personal communications network (PCN/DCS) 1800 (1710-1880 MHz); US wideband code division multiple access (US-WCDMA) 1900 (1850-1990 MHz); wideband code division multiple access (WCDMA) 2100 (Tx: 1920-1980 MHz Rx: 2110-2180 MHz); personal communications service (PCS) 1900 (1850-1990 MHz); ultra wideband (UWB) Lower (3100-4900 MHz); UWB Upper (6000-10600 MHz); digital video broadcasting-handheld (DVB-H) (470-702 MHz); DVB-H US (1670-1675 MHz); digital radio mondiale (DRM) (0.15-30 MHz); worldwide interoperability for microwave access (WiMax) (2300-2400 MHz, 2305-2360 MHz, 2496-2690 MHz, 3300-3400 MHz, 3400-3800 MHz, 5250-5875 MHz); digital audio broadcasting (DAB) (174.928-239.2 MHz, 1452.96-1490.62 MHz); radio frequency identification low frequency (RFID LF) (0.125-0.134 MHz); radio frequency identification high frequency (RFID HF) (13.56-13.56 MHz); radio frequency identification ultra high frequency (RFID UHF) (433 MHz, 865-956 MHz, 2450 MHz). An operational frequency band is a frequency range over which an antenna and radio circuitry can efficiently operate using a protocol. Efficient operation occurs, for example, when the antenna's insertion loss S11 is greater than an operational threshold such as 4 dB or 6 dB In the embodiment where the apparatus 10 is a portable device, the functional circuitry 16 may include a processor, a memory and input/output devices such as an audio input device (a microphone for example), an audio output device (a loudspeaker for example) and a display. The electronic components that provide the radio circuitry 14 and the functional circuitry 16 may be interconnected via a printed wiring board (PWB) 18. In various embodiments the printed wiring board 18 may be used as a ground member for the antenna 12 by using one or more layers of the printed wiring board 18, or some other conductive part of the apparatus 10 (a battery cover for example) may be used as a ground member for the antenna 12.

FIG. 2 illustrates a plan view of an antenna 12 according to various embodiments of the present invention. The antenna 12 is substantially planar in this exemplary embodiment and includes a first end 20 that is connectable to a terminal on the printed wiring board 18 (a feed terminal for example) and a second end 22 that is also connectable to a terminal on the printed wiring board 18 (a ground terminal for example). The antenna 12 also includes a conductive track 24 that forms a loop like structure between the first end 20 and the second end 22.

FIG. 2 also illustrates a Cartesian co-ordinate system 26 including an X axis 28, a Y axis 30 and a Z axis 32 (not illustrated in this figure) that are orthogonal to one another.

The conductive track 24 extends from the first end 20 in the −X direction until a position A and then forms a right angled, right handed turn and extends in the +Y direction until position B. The conductive track 24 extends from position B in the +X direction until position C where the conductive track 24 splits into a first conductive part 34 and a second conductive part 36.

The first conductive part 34 extends in the +X direction until position D and then forms a right angled, right handed turn and extends in the −Y direction until position E. The first conductive part 34 then forms a right angled, left handed turn and extends in the +X direction until position F. The first conductive part 34 then forms a right angled, left handed turn and extends in the +Y direction until position G. The first conductive part 34 then forms a right angled, right handed turn and extends in the +X direction until position J.

The second conductive part 36 extends from the position C in the −Y direction until position H. The second conductive part 36 then forms a right angled, left handed turn and extends in the +X direction until position I. The second conductive part 36 then forms a right angled, left handed turn and extends in the +Y direction until position J. The first conductive part 34 and the second conductive part 36 join together at the position J.

The conductive track 24 extends from the position J in the +X direction until position K. The conductive track 24 then forms a right angled, right handed turn and extends in the −Y direction until position L. The conductive track 24 forms a right angled, right handed turn and extends in the −X direction until the second end 22.

From the foregoing description, it should be appreciated that the first conductive part 34 and the second conductive part 36 form U shaped loop structures between the positions C and J and are arranged to be electrically in parallel with one another. Additionally, it should be appreciated that the physical length of the first conductive part 34 is shorter than the physical length of the second conductive part 36.

A portion of the first conductive part 34 between position E and position F is positioned in relatively close proximity to the first end 20 and the second end 22 of the conductive track 24. The portion between positions E and F is approximately half way along the length of the conductive track 24 (including the first conductive part 34) between the first end 20 and the second end 22.

A portion of the second conductive part 36 between position H and position I is also positioned in relatively close proximity to the first end 20 and the second end 22 of the conductive track 24. For example, the distance between the portion between H and I and the ends 20, 22 may be from 0.1 mm to 5.0 mm. Additionally, the portion between positions H and I may also be, at least partially, positioned in relatively close proximity to the portion between positions E and F of the first conductive part 34. The portion between positions H and I is approximately half way along the length of the conductive track 24 (including the second conductive part 36) between the first end 20 and the second end 22.

The first conductive part 34 may be configured to have a first electrical length (L1) that provides the antenna 12 with a differential resonant mode having a first operational frequency band (for example, personal communications service (PCS) 1900 (1850-1990 MHz)). In a differential resonant mode, the current flows in different directions at the first and second ends 20, 22 (for example, into the first end 20 and out of the second end 22, or out of the first end 20 and into the second end 22). For example, the direction of the flow of current at the first end 20 may be in the −X direction (that is, out of the first end 20) and the direction of the flow of current at the second end 22 may be in the −X direction (that is, towards the second end 22). The first conductive part 34 may be configured so that it has particular dimensions (physical length, physical width for example) and/or has reactive loading that provides the antenna 12 (including the first conductive part 34) with an electrical length that is substantially equal to a wavelength of an electromagnetic wave in the first operational frequency band.

Embodiments of the present invention provide an advantage in that they may enable an antenna designer to design the antenna 12 so that the differential resonant mode has a desired operational frequency band. For example, if an antenna designer would like a differential resonant mode of the antenna 12 to cover the personal communications service band (1850-1990 MHz), he may configure the first conductive portion 34 as mentioned above to enable the antenna 12 to cover that operational frequency band. Additionally, since the first conductive part 34 and the second conductive part 36 are arranged electrically in parallel, the configuration of the first conductive part 34 may not substantially affect resonant modes provided by the second conductive part 36.

Additionally or alternatively, the second conductive part 36 may be configured to have a second electrical length (L2) that provides the antenna 12 with a differential resonant mode having a second operational frequency band. The second conductive part 36 may be configured so that it has particular dimensions (physical length, physical width for example) and/or has reactive loading that provides the antenna 12 (including the second conductive part 36) with an electrical length that is substantially equal to a wavelength of an electromagnetic wave in the second operational frequency band. The second operational frequency band may at least partially overlap the first operational frequency band and may advantageously provide the antenna 12 with a relatively large frequency bandwidth. Alternatively, the second operational frequency band may not overlap with the first operational frequency band.

FIG. 3 illustrates a perspective view of an apparatus 10 according to various embodiments of the invention. The antenna 12 illustrated in FIG. 3 is similar to the antenna illustrated in FIG. 2 and where the features are similar, the same reference numerals are used. FIG. 3 also illustrates the Cartesian co-ordinate system 26 including the X axis 28, the Y axis 30 and the Z axis 32.

The printed wiring board 18 (a ground plane in this embodiment) includes a first terminal 38 (a feed terminal for example) and a second terminal 40 (a ground terminal for example) at a first end 42 of the printed wiring board 18. The antenna 12 is mounted on a support member 44 and has a height above the printed wiring board 18.

The support member 44 may comprise any dielectric material and includes a top surface 46 (in the X-Y plane), a first side surface 48 (in the X-Z plane), a second side surface 50 (in the Y-Z plane) and a third side surface 52 (in the Y-Z plane). The first end 20 of the conductive track 24 is connected to the first terminal 38 and the second end 22 of the conductive track 24 is connected to the second terminal 40. Consequently, the antenna 12 at least partially overlays the ground member 18.

The antenna 12 illustrated in FIG. 3 is similar to the antenna illustrated in FIG. 2 but does have a number of differences. The antenna 12 of FIG. 3 is non-planar and includes portions on the top surface 46, the first side surface 48, the second side surface 50 and the third side surface 52 of the support member 44. Alternatively or in addition, the antenna 12 may include further portions on other surfaces not specifically mentioned here, different to the top surface 46, first side surface 48, second side surface 50 and third side surface 52.

In more detail, the conductive track 24 between the first end 20 and position A and between the second end 22 and position L is provided on the first side surface 48. The conductive track 24 between position A and position B is provided partially on the top surface 46 and partially on the second side surface 50. The first and second conductive parts 34, 36 are provided on the top surface 46. The conductive track 24 between position K and L is provided partially on the top surface 46 and partially on the third side surface 52. The antenna 12 additionally includes a first patch portion 54 connected to the conductive track 24 at position B and a second patch portion 56 connected to the conductive track 24 at position K. The antenna 12 may have dimensions of 40.0 mm by 15.0 mm by 6.0 mm.

The antenna 12 illustrated in FIG. 3 may also include a ground plane as part of the printing wiring board 18 or other alternative component which extends completely under the antenna 12 in the −Y direction up to the edge created by the first side surface 48 and the printed wiring board 18. Alternatively the ground plane may extend only partially under the antenna 12, and so ending before it reaches the edge created by the first side surface 48 and the printed wiring board 18 in the −Y direction.

Figure 4:
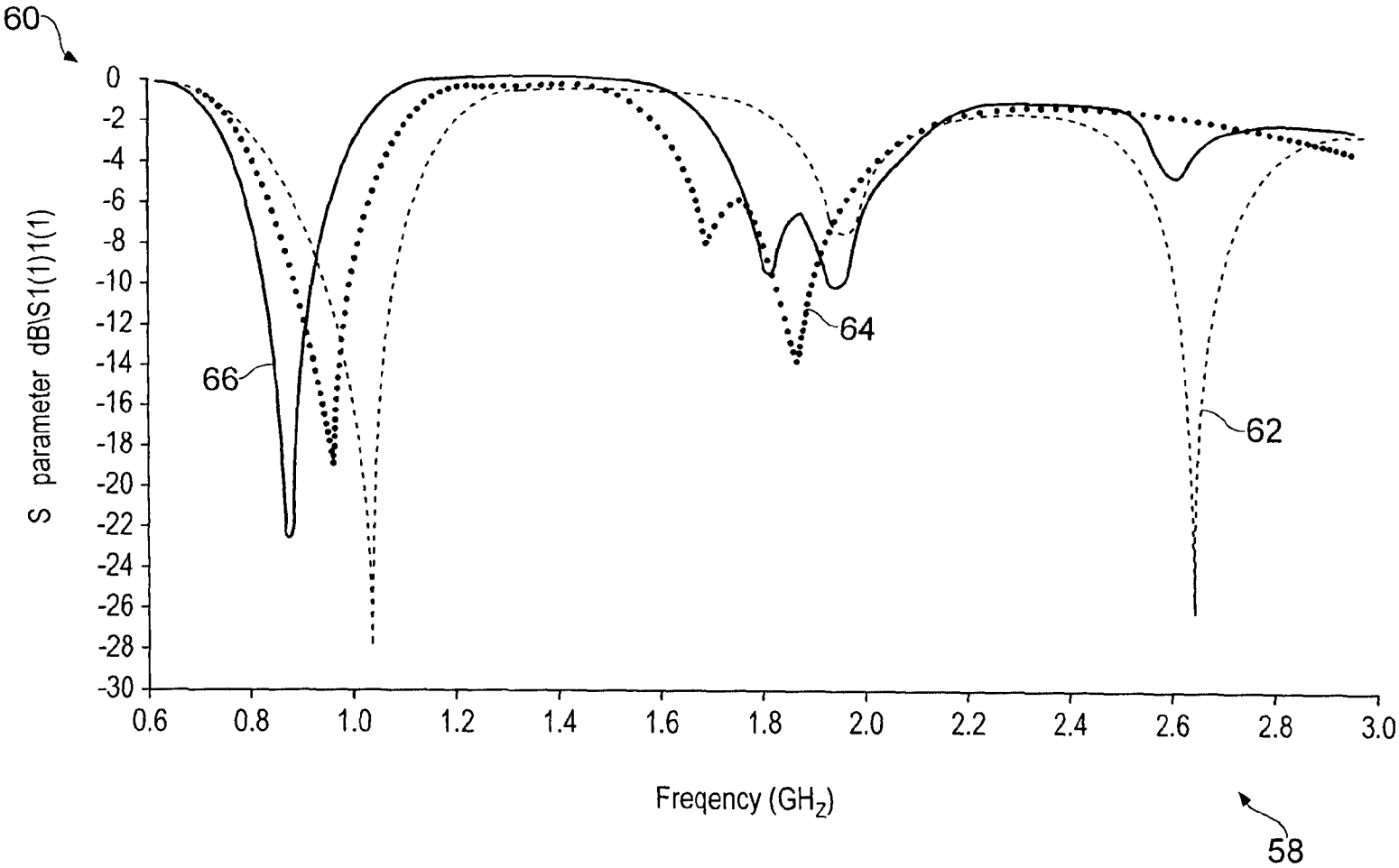
FIG. 4 illustrates a graph of frequency versus scattering parameter for the antenna illustrated in FIG. 3.

FIG. 4 illustrates a graph of frequency versus scattering parameter for the antenna 12 illustrated in FIG. 3. The graph includes a horizontal axis 58 for frequency of operation and a vertical axis 60 for the scattering parameter S11. The graph also includes a first trace 62 for the antenna 12 including the first conductive part 34 (with the second conductive part 36 removed), a second trace 64 for the antenna 12 including the second conductive part 36 (with the first conductive part 34 removed), and a third trace 66 for the antenna 12 including the first conductive part 34 and the second conductive part 36. The first trace 62 is indicated by a dashed line, the second trace 64 is indicated by a dotted line and the third trace 66 is indicated by a continuous line.

The first trace 62 includes a first minima at a frequency of approximately 1.05 GHz and a scattering parameter of approximately −28 dB. The first minima corresponds to a common first resonant mode of the antenna 12 (a half wavelength mode) including the first conductive part 34. In a common resonant mode, the current flows in the same directions at the first and second ends 20, 22 (for example, into the first and second ends 20, 22 or out of the first and second ends 20, 22). The proximity of the E to F portion of the first conductive part 34 to the first and second terminals 38, 40 may result in capacitive loading which may reduce the resonant frequency and/or extend the operational frequency band of the common first resonant mode.

The first trace 62 also includes a second minima at a frequency of approximately 1.9 GHz and a scattering parameter of approximately −8 dB. The second minima corresponds to a differential second resonant mode of the antenna 12 (a wavelength mode) including the first conductive part 34. The first and second patch portions 54, 56 may result in capacitive loading which may reduce the resonant frequency and/or extend the operational frequency band of the differential second resonant mode.

The first trace 62 includes a third minima at a frequency of approximately 2.7GHz and a scattering parameter of approximately −26 dB. The third minima corresponds to a common third resonant mode of the antenna 12 (a one and a half wavelength mode) including the first conductive part 34. The proximity of the E to F portion of the first conductive part 34 to the first and second terminals 38, 40 may result in capacitive loading which may reduce the resonant frequency and/or extend the operational frequency band of the common third resonant mode.

The second trace 64 includes a first minima at a frequency of approximately 0.95 GHz and a scattering parameter of approximately −19 dB. The first minima corresponds to a common first resonant mode of the antenna 12 (a half wavelength mode) including the second conductive part 36. The proximity of the H to I portion of the second conductive part 36 to the first and second terminals 38, 40 may result in capacitive loading which may reduce the resonant frequency and/or extend the operational frequency band of the common first resonant mode.

The second trace 64 also includes a second minima at a frequency of approximately 1.7 GHz and a scattering parameter of approximately −8 dB. The second minima corresponds to a differential second resonant mode of the antenna 12 (a wavelength mode) including the second conductive part 36. The first and second patch portions 54, 56 may result in capacitive loading which may reduce the resonant frequency and/or extend the operational frequency band of the differential second resonant mode.

The second trace 64 includes a third minima at a frequency of approximately 1.85 GHz and a scattering parameter of approximately −13 dB. The third minima corresponds to a common third resonant mode of the antenna 12 (a one and a half wavelength mode) including the second conductive part 36. The proximity of the H to I portion of the second conductive part 36 to the first and second terminals 38, 40 may result in capacitive loading which may reduce the resonant frequency and/or extend the operational frequency band of the common third resonant mode. An antenna designer may tune the one and a half wavelength mode independently of the one wavelength mode by changing the coupling (distance) between the first and second terminals 38, 40 and the second conductive part 36. Consequently, the one and a half wavelength mode may have a higher or lower operational frequency band than the one wavelength mode.

As mentioned above, the third trace 66 relates to the performance of the antenna 12 as a whole and including the first conductive part 34 and the second conductive part 36. The third trace 66 includes a first minima at a frequency of approximately 0.90 GHz and a scattering parameter of approximately −23 dB. The first minima corresponds to a common first resonant mode of the antenna 12 (a half wavelength mode) and is provided by the first conductive part 34 and the second conductive part 36. The proximity of the E to F portion of the first conductive part 34 to the H to I portion of the second conductive part 36 may result in capacitive loading which may reduce the resonant frequency and/or extend the operational frequency band of the common first resonant mode.

The third trace 66 also includes a second minima at a frequency of approximately 1.8 GHz and a scattering parameter of approximately −9 dB. The second minima corresponds to a common second resonant mode of the antenna 12 (a one and a half wavelength mode) and is substantially provided by the second conductive part 36. The proximity of the H to I portion of the second conductive part 36 to the E to F portion of the first conductive part 34 may result in capacitive loading which may reduce the resonant frequency and/or extend the operational frequency band of the common second resonant mode.

The third trace 66 includes a third minima at a frequency of approximately 1.9 GHz and a scattering parameter of approximately −9 dB. The third minima corresponds to a differential third resonant mode of the antenna 12 (a one wavelength mode) and is substantially provided by the first conductive part 34. The first and second patch portions 54, 56 may result in capacitive loading which may reduce the resonant frequency and/or extend the operational frequency band of the differential third resonant mode.

The common first resonant mode of the antenna 12 may, for example, cover the US-Global system for mobile communications (US-GSM) 850 (824-894 MHz) and the European global system for mobile communications (EGSM) 900 (880-960 MHz). The common second resonant mode of the antenna 12 may, for example, cover the personal communications network (PCN/DCS) 1800 (1710-1880 MHz). The differential third resonant mode of the antenna 12 may, for example, cover the personal communications service (PCS) 1900 (1850-1990 MHz). Consequently, the antenna 12 may cover four operational frequency bands.

Figure 5A:
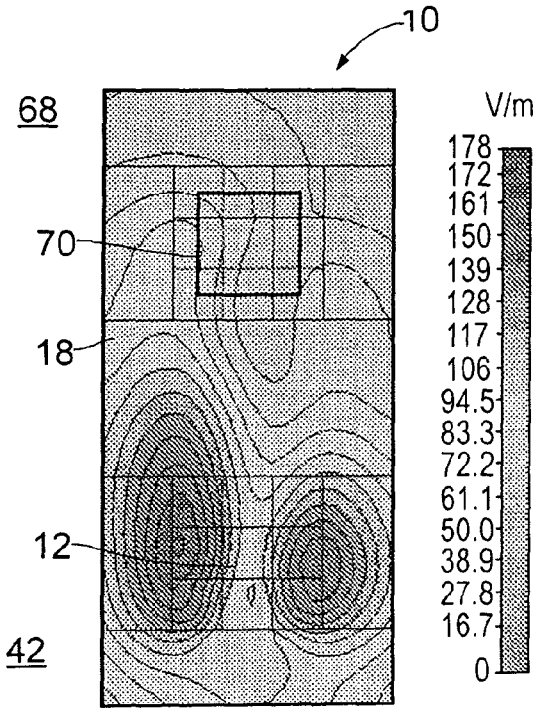
FIG. 5A illustrates a plan view of electric field strength for a differential resonant mode of the antenna illustrated in FIG. 3.

FIG. 5A illustrates a plan view of electric field strength across the apparatus 10 for the differential third resonant mode of the antenna 12 illustrated in FIG. 3. In more detail, FIG. 5A illustrates the ground member 18 having a first end 42 and a second opposite end 68. The antenna 12 is positioned at the first end 42 and an audio output device 70 (a loudspeaker for example) is positioned at the second end 68. The electric field has a first maxima in strength in proximity to a first corner of the first end 42 and a second maxima in strength in proximity to a second corner of the first end 42. The electric field strength is relatively low at the second end 68.

Figure 5B:
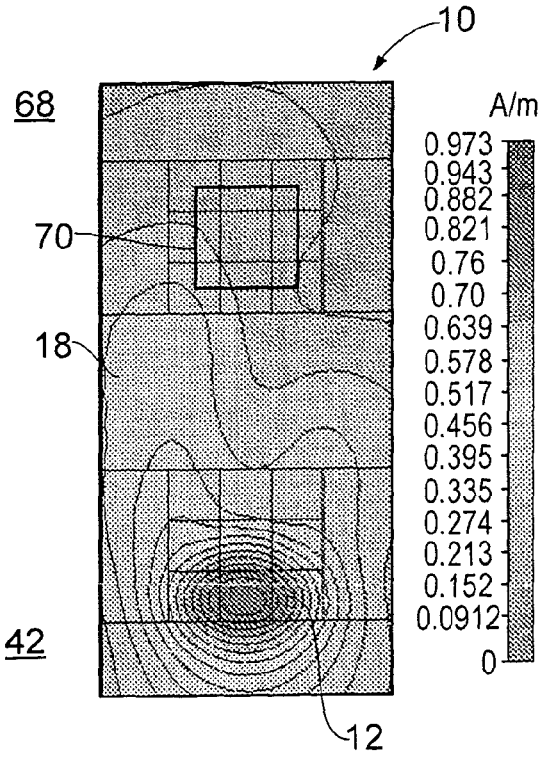
FIG. 5B illustrates a plan view of magnetic field strength for a differential resonant mode of the antenna illustrated in FIG. 3.

FIG. 5B illustrates a plan view of magnetic field strength across the apparatus 10 for the differential third resonant mode of the antenna 12 illustrated in FIG. 3. In more detail, FIG. 5B illustrates the ground member 18 having a first end 42 and a second opposite end 68. The antenna 12 is positioned at the first end 42 and an audio output device 70 (a loudspeaker for example) is positioned at the second end 68. The magnetic field strength has a maxima in strength in the centre of the first end 42. The magnetic field strength is relatively low at the second end 68.

From the preceding paragraphs, it should be appreciated that the differential third resonant mode of the antenna 12 produces relatively low strength electromagnetic radiation at the second end 68 of the ground member 18. Differential modes do not substantially electromagnetically couple with ground members (unlike common modes) and consequently, the ground member 18 may radiate little to no electromagnetic radiation (near field radiation) at the second end 68.

Embodiments of the present invention provide an advantage in that the differential third resonant mode of the antenna 12 may produce little to no electromagnetic radiation at the second end 68 and may consequently cause little to no electromagnetic interference with the audio output device 70 positioned at the second end 68. Consequently, the differential third resonant mode may provide a hearing aid compliant (HAC) mode. Since an antenna designer is able to configure the antenna 12 to select a particular operational frequency band for the differential mode, the designer may be able to select a particular operational frequency band for the hearing aid compliant (HAC) mode.

Figure 6:
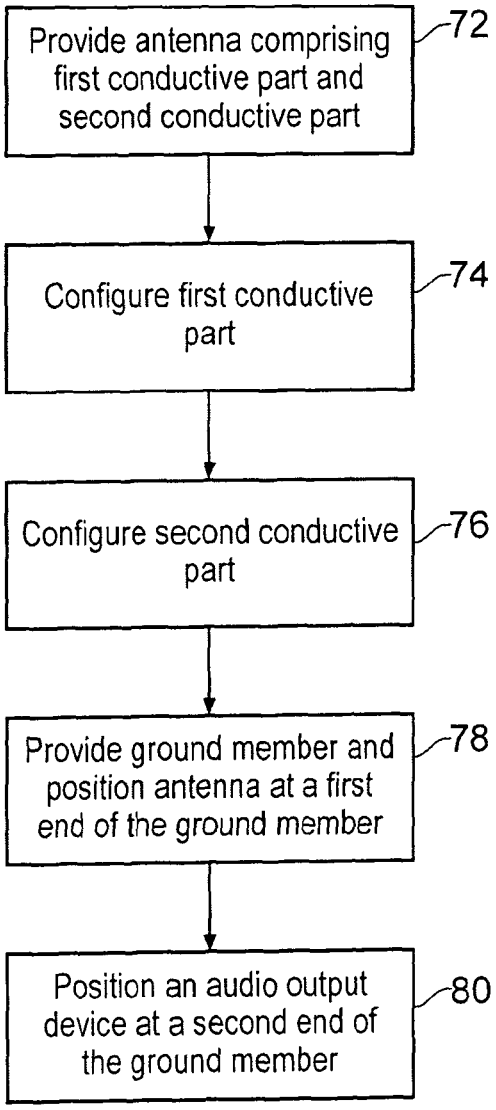
FIG. 6 illustrates a flow diagram of a method for manufacturing an apparatus according to various embodiments of the invention.

FIG. 6 illustrates a flow diagram of a method for manufacturing an apparatus 10 according to various embodiments of the invention. It should be appreciated that the illustration of a particular order to the blocks does not necessarily imply that there is a required or preferred order for the blocks and the order and arrangement of the block may be varied. Furthermore, it may be possible for some blocks to be omitted.

At block 72, the method includes providing an antenna 12 according to various embodiments of the invention including a first conductive part 34 and a second conductive part 36.

At block 74, the method includes configuring the first conductive part 34 to have an electrical length that provides the antenna 12 with a differential resonant mode having a first operational frequency band. The first conductive part 34 may be sized and/or shaped and/or provided with reactive portions that result in a desired electrical length.

At block 76, the method may include configuring the second conductive part 36 to have an electrical length that provides the antenna 12 with a differential resonant mode having a second operational frequency band. The second conductive part 36 may be sized and/or shaped and/or provided with reactive portions that result in a desired electrical length.

At block 78, the method includes providing a ground member 18 and positioning the antenna 12 at a first end 42 of the ground member 18. The first end 20 of the antenna 12 may be connected to the first terminal 38 and the second end 22 of the antenna 12 may be connected to the second terminal 40.

At block 80, the method includes positioning an audio output device 70 at a second end 68 of the ground member 18.

Although embodiments of the present invention have been described in the preceding paragraphs with reference to various examples, it should be appreciated that modifications to the examples given can be made without departing from the scope of the invention as claimed. For example, an antenna 12 may have any suitable size or shape and may have any number of conductive parts arranged electrically in parallel with one another that may provide more than two differential resonant modes for the antenna 12.

The antenna 12 may be configured (by changing the layout of the antenna 12) to have one or more differential resonant modes with different operational frequency bands to those described above with reference to FIG. 4. For example, the antenna 12 may be configured to have a common first resonant mode (half a wavelength mode) provided by the first conductive part 34 and the second conductive part 36, a differential second resonant mode (one wavelength mode) having an operational frequency band provided by the first conductive part 34, a differential third resonant mode (one wavelength mode) having an operational frequency band provided by the second conductive part 36, and a common fourth resonant mode (one and a half wavelength mode) having an operational frequency band provided by the second conductive part 36.

A hearing aid compliant (HAC) mode, provided by a differential resonant mode, has an operational frequency band at which the electric and magnetic radiating field strengths at the second end 68 are below certain threshold levels. It should be appreciated that the operational frequency band of a hearing aid compliant (HAC) mode may be more narrow than, and/or only partly overlapping with, the operational frequency band of the providing differential resonant mode.

Figure 7:
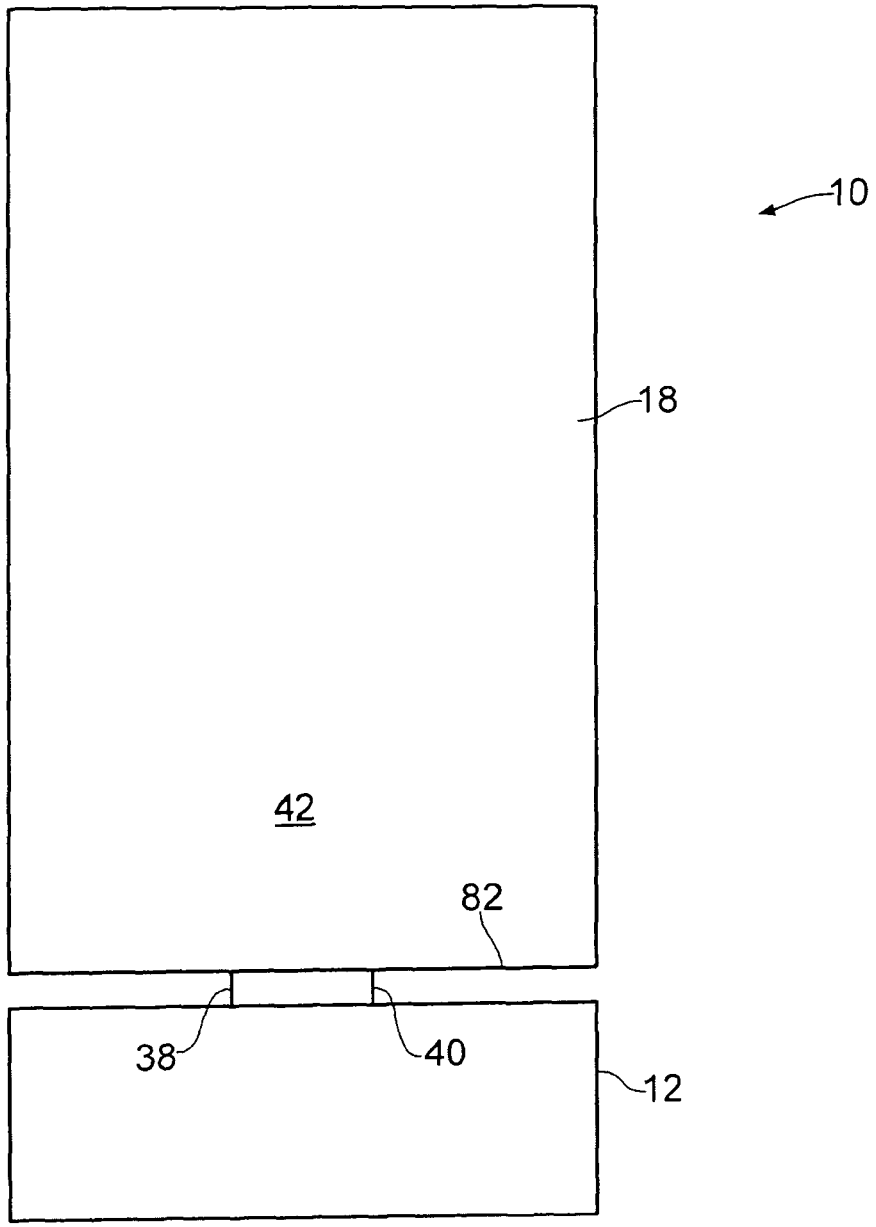
FIG. 7 illustrates a plan view of an apparatus 10 according to various embodiments of the invention.

In various embodiments, the antenna 12 may be positioned adjacent the ground member 18 in a non-overlaying arrangement. Such an arrangement is illustrated in FIG. 7 where the antenna 12 is positioned adjacent a side edge 82 of the first end 42 of the ground member 18. The first and second terminals 38, 40 may extend from the side edge 82 for connection with the antenna 12. The antenna 12 may, for example, have the dimensions 65.0 mm by 11.5 mm by 5.0 mm.

Figure 8:
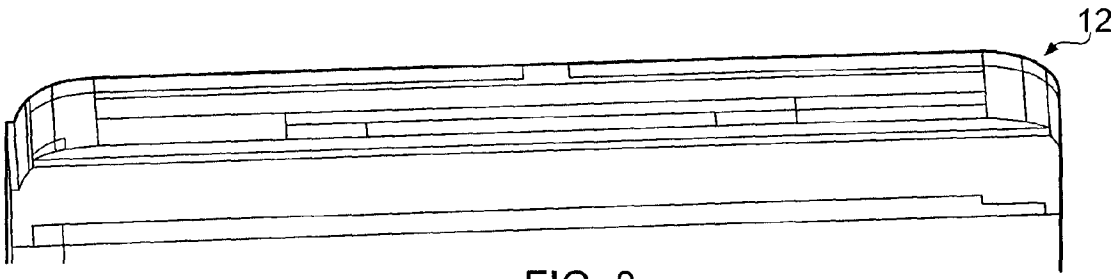
FIG. 8 illustrates a perspective view of another apparatus 10 according to various embodiments of the invention.

FIG. 8 illustrates a perspective view of another antenna 12 according to various embodiments of the present invention. In these embodiments, the antenna 12 is a dual loop antenna (where one loop is physically longer than the other loop) that is positioned off the ground plane in a non-overlaying arrangement.

Figure 9:
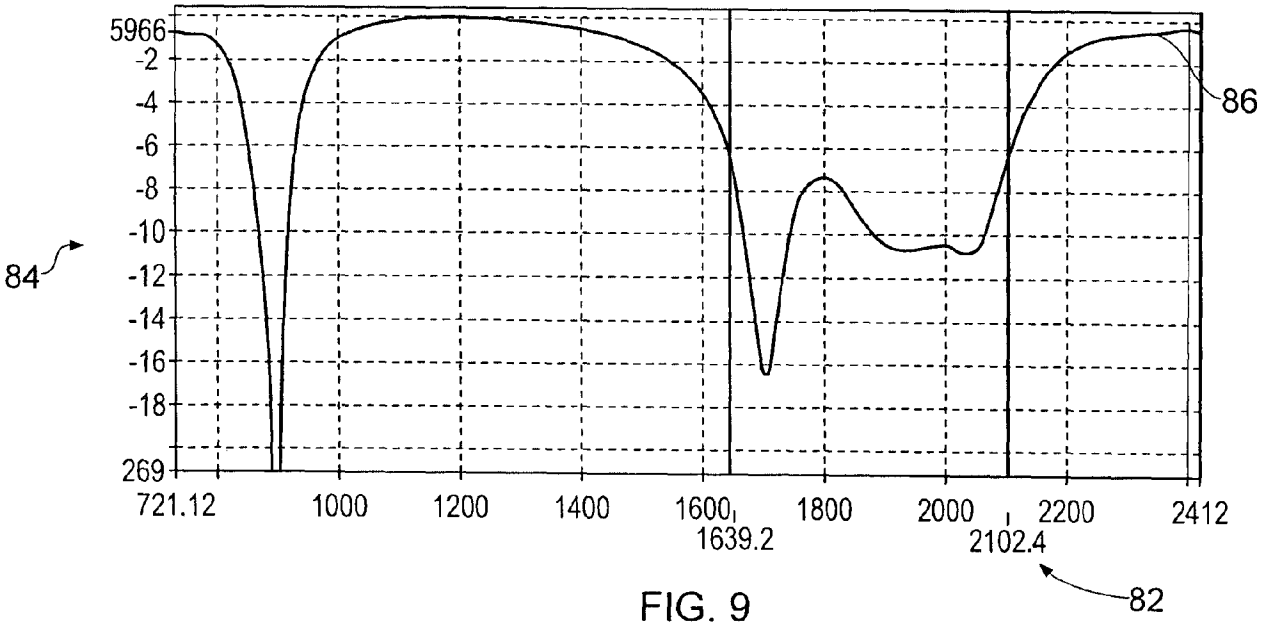
FIG. 9 a graph of frequency versus scattering parameter for the antenna illustrated in FIG. 8

FIG. 9 illustrates a graph of frequency versus scattering parameter for the antenna 12 illustrated in FIG. 8. The graph includes a horizontal axis 82 for frequency of operation and a vertical axis 84 for the scattering parameter S11. The graph also includes a trace 86 that represents the scattering parameter of the antenna 12 at various frequencies.

The trace 86 includes a first minima at a frequency of approximately 0.9 GHz and a scattering parameter of approximately −27 dB. The first minima corresponds to a common first resonant mode of the antenna 12 (a half wavelength mode) including both loops of the antenna 12.

The trace 86 also includes a second minima at a frequency of approximately 1.7 GHz and a scattering parameter of approximately −17 dB. The second minima corresponds to a differential second resonant mode of the antenna 12 (a wavelength mode) including the physically longer loop.

The trace 86 includes a third minima at a frequency of approximately 1.9 GHz and a scattering parameter of approximately −11 dB. The third minima corresponds to a differential third resonant mode of the antenna 12 (a one wavelength mode) including the physically shorter loop.

The trace 86 includes a fourth minima at a frequency of approximately 2.05 GHz and a scattering parameter of approximately −11 dB. The fourth minima corresponds to a common fourth resonant mode of the antenna 12 (a one and a half wavelength mode) including the physically longer loop.

The antenna 12 illustrated in FIG. 8 is configured to resonate efficiently in a relatively wide frequency band (the three higher resonant modes covering approximately 1.6 GHz to 2.1 GHz). This frequency band may advantageously encompass a plurality of different operational frequency bands.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the applicant claims protection in respect of any patentable feature or combination of features hereinbefore referred to and/or shown in the drawings whether or not particular emphasis has been placed thereon.

We claim:

1. Apparatus comprising:

an antenna connectable to a first feed terminal and to a second terminal and comprising a conductive track having a loop structure, a first conductive part and a second conductive part, the first conductive part being configured electrically in parallel with the second conductive part, the first conductive part being configured to have a first electrical length that provides a differential resonant mode having a first operational frequency band; and a ground member having a first end and a second end and comprising a first feed terminal at the first end and connectable to the antenna, and a second terminal at the first end and connectable to the antenna, wherein the first conductive part comprises a portion positioned in proximity to the first feed terminal and to the second terminal and configured to electromagnetically couple to the first feed terminal and to the second terminal, and wherein the second conductive part comprises a portion positioned in proximity to the first feed terminal and to the second terminal and configured to electromagnetically couple to the first feed terminal and to the second terminal.

2. Apparatus as claimed in claim 1, wherein the first conductive part is configured to provide the antenna, including the first conductive part, with an electrical length substantially equal to a wavelength of an electromagnetic wave in the first operational frequency band.

3. Apparatus as claimed in claim 1, wherein the second conductive part is configured to have a second electrical length that provides a differential resonant mode having a second operational frequency band.

4. Apparatus as claimed in claim 3, wherein the second conductive part is configured to provide the antenna, including the second conductive part, with an electrical length substantially equal to a wavelength of an electromagnetic wave in the second operational frequency band.

5. Apparatus as claimed in claim 3, wherein the first operational frequency band and the second operational frequency band at least partially overlap.

6. Apparatus as claimed in claim 3, wherein the first operational frequency band and the second operational frequency band are non-overlapping.

7. Apparatus as claimed in claim 3, wherein the first conductive part is physically shorter than the second conductive part.

8. Apparatus as claimed in claim 3, wherein the antenna is positioned to at least partially overlay the ground member or wherein the antenna is positioned adjacent the ground member in a non-overlaying arrangement.

9. Apparatus as claimed in claim 3, further comprising an audio output device positioned at the second end of the ground member and configured to provide sound waves to a user, the differential resonant mode of the antenna providing a Hearing Aid Compliant (HAC) mode.

10. A module comprising an apparatus as claimed in claim 3.

11. A portable device comprising an apparatus as claimed in claim 3.

12. A method comprising:

providing an antenna connectable to a first feed terminal and to a second terminal and comprising a conductive track having a loop structure, a first conductive part and a second conductive part, the first conductive part being configured electrically in parallel with the second conductive part;

configuring the first conductive part to have a first electrical length that provides a differential resonant mode having a first operational frequency band; and providing a ground member having a first end and a second end and comprising a first feed terminal at the first end and connectable to the antenna, and a second terminal at the first end and connectable to the antenna;

wherein the first conductive part comprises a portion positioned in proximity to the first feed terminal and to the second terminal and configured to electromagnetically couple to the first feed terminal and to the second terminal;

wherein the second conductive part comprises a portion positioned in proximity to the first feed terminal and to the second terminal and configured to electromagnetically couple to the first feed terminal and to the second terminal.

13. A method as claimed in claim 12, wherein configuring the first conductive part provides the antenna, including the first conductive part, with an electrical length substantially equal to a wavelength of an electromagnetic wave in the first operational frequency band.

14. A method as claimed in claim 12, further comprising configuring the second conductive part to have a second electrical length that provides a differential resonant mode having a second operational frequency band.

15. A method as claimed in claim 14, wherein configuring the second conductive part provides the antenna, including the second conductive part, with an electrical length substantially equal to a wavelength of an electromagnetic wave in the second operational frequency band.

16. A method as claimed in claim 14, wherein the first operational frequency band and the second operational frequency band at least partially overlap.

17. A method as claimed in claim 14, wherein the first operational frequency band and the second operational frequency band are non-overlapping.

18. A method as claimed in claim 12, wherein the first conductive part is physically shorter than the second conductive part.

19. A method as claimed in claim 12, further comprising positioning the antenna to at least partially overlay the ground member or further comprising positioning the antenna adjacent the ground member in a non-overlaying arrangement.

20. A method as claimed in claim 12, further comprising positioning an audio output device at the second end of the ground member and configured to provide sound waves to a user, the differential resonant mode of the antenna providing a Hearing Aid Compliant (HAC) mode.

* * * * *